United States Patent [19]

Göhrich et al.

[11] Patent Number: 4,507,593

[45] Date of Patent: Mar. 26, 1985

[54] SYSTEM FOR CONTROLLING A SPATIALLY MOVABLE DEVICE

[75] Inventors: Klaus Göhrich, Küssaberg; Heinz Vogt, Oberehrendingen, both of Fed. Rep. of Germany

[73] Assignee: BBC Brown, Boveri & Company, Limited, Baden, Switzerland

[21] Appl. No.: 589,054

[22] Filed: Mar. 15, 1984

Related U.S. Application Data

[63] Continuation of Ser. No. 354,356, Mar. 3, 1982, abandoned.

[30] Foreign Application Priority Data

Mar. 11, 1981 [CH] Switzerland ..... 1651/81

[51] Int. Cl.[3] ..... H01H 9/02

[52] U.S. Cl. ..... 318/563; 200/157

[58] Field of Search ..... 128/376; 318/3, 9, 625, 318/563, 671, 672, 51, 59, 342, 305, 443, 490, 549, 446; 200/157

[56] References Cited

PUBLICATIONS

Brown Boveri Review, 9/10-83, pp. 318-323.
"Asklepitron-45", Messrs. BBC (CH-E 6.0017.1.E), Baden/Switzerland.
"Therasim 720", Messrs. AECL (Med. 54, 3/72).
"Clinac 6/100", Messrs. Varian (RAD 1826A, 2/79).

*Primary Examiner*—S. J. Witkowski
*Assistant Examiner*—Patrick C. Keane
*Attorney, Agent, or Firm*—Oblon, Fisher, Spivak, McClelland & Maier

[57] ABSTRACT

A spatially movable device 1 is disclosed which is provided with actuators *7a–7f* in such a manner that the system consists of a manual unit 2 with a process control unit 5 and a input unit 6 as well as a monitor 8. The manual unit 2 is operated in such a manner that the control elements *3a–3f* are controlled by an operator's hand which through individual fingers controls the selection of various position parameters. A slider 4 is provided which controls the direction and speed of the selected parameter change with the slider being accessible to the thumb of the operator in order to provide complete operation by one hand and simultaneously setting and controlling the parameter values which are displayed on the monitor 8.

9 Claims, 3 Drawing Figures

SYSTEM FOR CONTROLLING A SPATIALLY MOVABLE DEVICE

This application is a continuation of application Ser. No. 354,356, filed Mar. 3, 1982, now abandoned.

BACKGROUND OF THE INVENTION

1. Field of the Invention

The invention relates to a system for providing control of the position parameters of a movable device.

2. Description of the Prior Art

Such a system is known, for example, from the publication "Clinac 6/100" by Messrs. Varian (RAD 1826 A 2/79). In this publication, the spatially movable device to be controlled consists of a Linac and a surgical bed. A manual unit of the system is disclosed on page 6 of this publication. One of the disadvantages of this unit is that both hands are needed to operate it. The patient can therefore not be looked after while the Linac or the surgical bed is being adjusted.

From the publication "Asklepitron-45" by Messrs. BBC (CH-E 6.0017.1.E) a control unit for a betatron and a surgical bed is known, which is permanently installed on a pedestal. The so-called "deadman's requirement", namely that the capability for initiating a change in parameters must be provided via two mechanically and electrically separate signal circuits, is not met in this system. In similar control units a foot pedal is used to meet the deadman's requirement.

From the publication "Therasim 720" by Messrs. AECL (Med. 54 3/72), a system for controlling a therapy unit and a surgical bed is known in which a manual unit, an input unit and an electronic process control unit are shown. Both hands are needed to operate the manual unit.

All systems described above have the additional disadvantage that a direct comparison between the parameter values set and the nominal values is not possible.

Another disadvantage consists in the fact that the keys of the control unit can be accidentally or even deliberately blocked. When the control units do not have the deadman's function, serious consequences can result for the patient, especially in the case of systems without protection against accidental contact in which, for example, all parameter changes are immediately interrupted if the radiator head is touched.

SUMMARY OF THE INVENTION

Accordingly, one object of this invention is to provide a novel system of the type initially mentioned, in such a manner that the manual unit can be operated with one hand, the deadman's requirement is met and all desired parameter values can be read off directly on a large display monitor.

This object is achieved by a system for controlling the position parameters of a spatially movable device having a manual unit which is provided with control elements for influencing the parameters and is effectively connected via a process control unit including an input unit to the actuators acting on the parameters of the device and to a monitor. The control elements comprise on the one hand keys which are disposed to be accessible to the index, middle, ring and little finger of one hand of the operator through which in each case one position parameter can be selected. Likewise there is included a slider which is disposed to be accessible to the thumb of the same hand which can be deviated from a stable rest position in two directions where the deviation of the slider control the direction and speed of the position parameter selected by one key and where the value of the deviation is a measure of the speed of change of the selected position parameter and furthermore the rest position of the slider does not allow for a change in the position parameter.

The advantages achieved by the invention can essentially be seen in the fact that the operator still has one hand available, for example in order to be able to sit up the patient in the instance where the system includes a therapy unit and surgical bed. Fulfilment of the deadman's function is thus guaranteed to the full extent and the correctness of the parameter values set in the whole space can be immediately checked on the monitor.

The invention can be easily applied also to other types of spatially movable devices such as lifting gear, especially cranes, and machine tools. Here the invention also eliminates some sources of danger, for example when trucks are being loaded by means of a crane.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
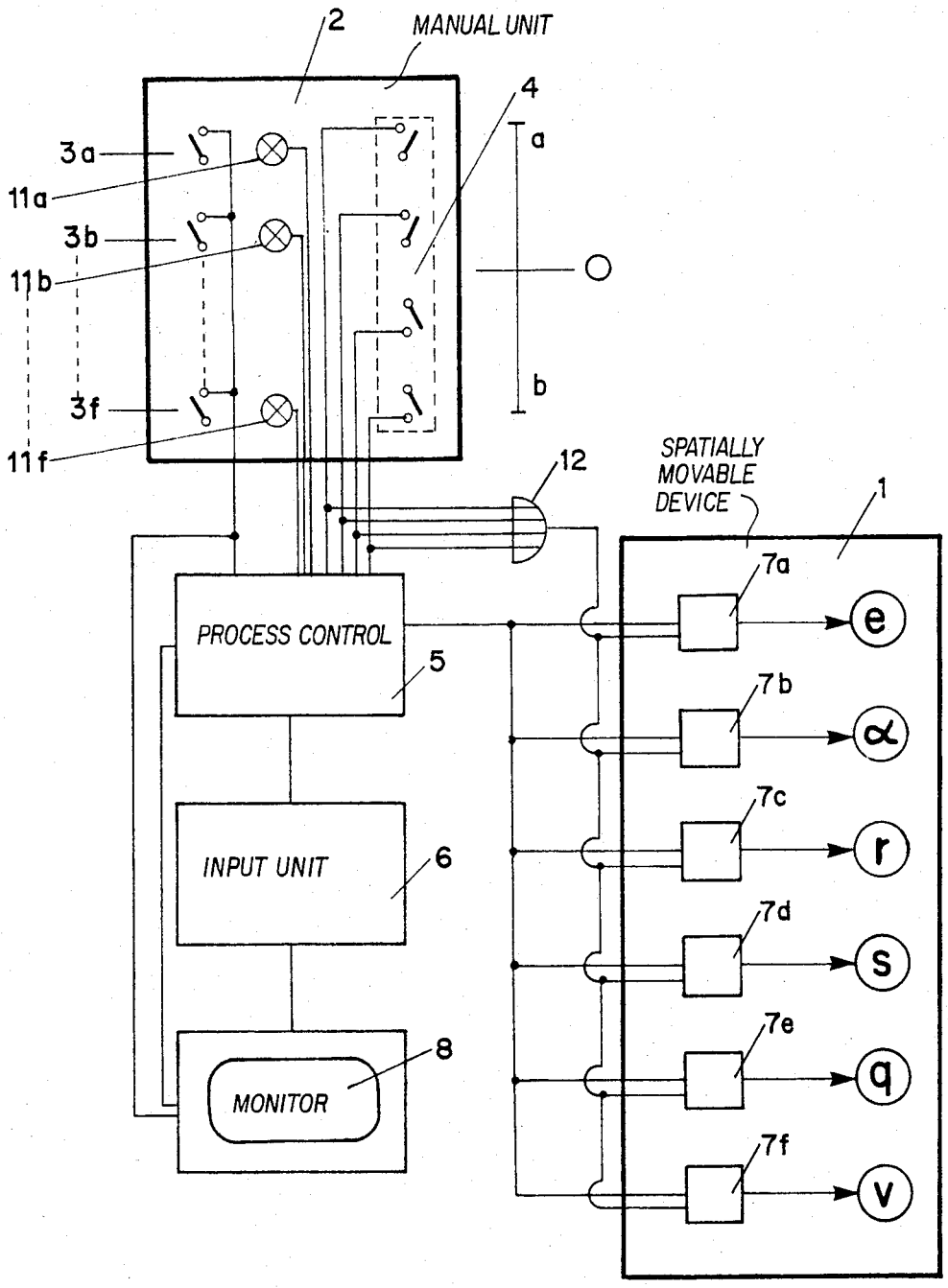
FIG. 1 shows a diagram of a system, according to the invention, for controlling the position parameters of a spatially movable device.
Figure 2:
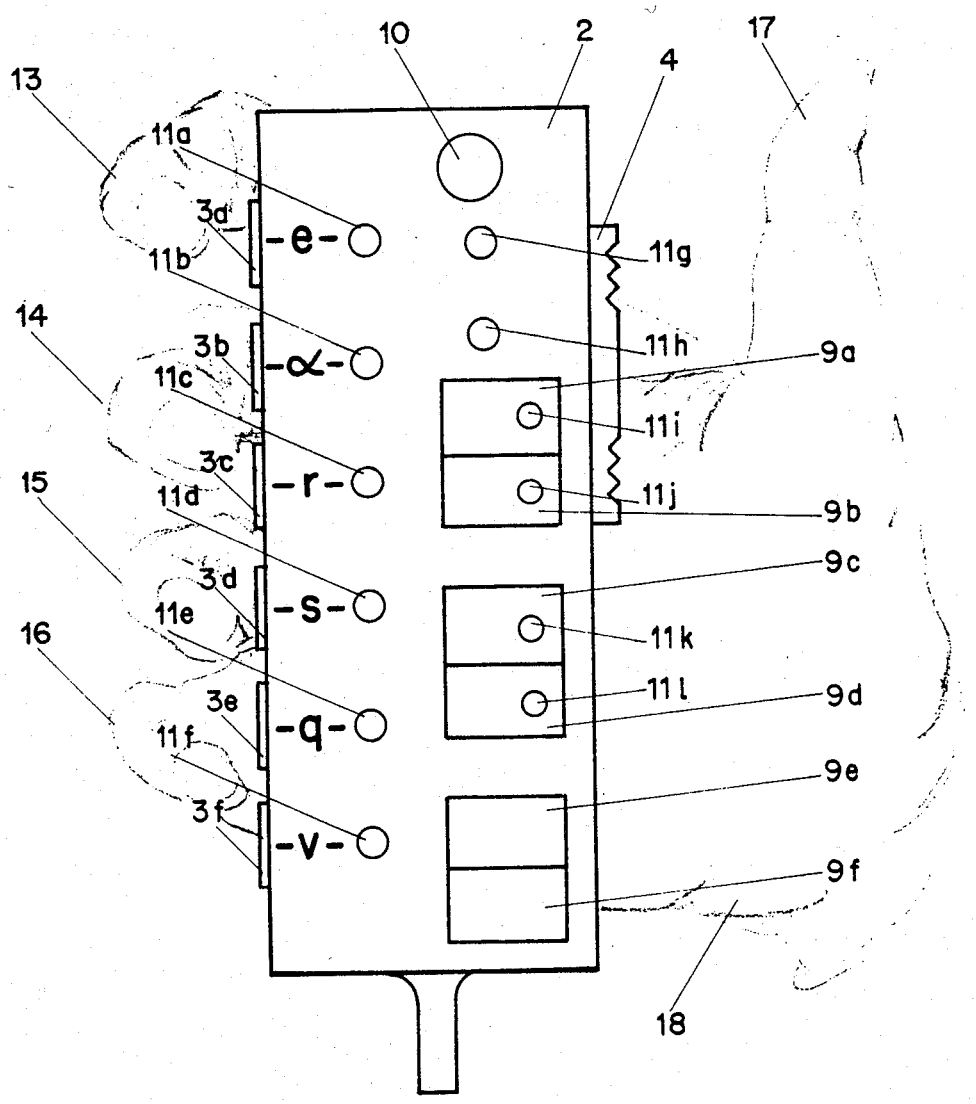
FIG. 2 shows the manual unit of the system viewed from the outside.

Referring now to the drawings, wherein like reference numerals designate identical or corresponding parts throughout the several views, and more particularly to FIG. 1 thereof, there is shown a system for controlling the position parameters e, $\alpha$, r, s, q, v of the spatially movable device 1. The basic configuration of the unit consists of a manual unit 2, an electronic process control unit 5 including an input unit 6, a monitor 8 and an OR gate 12.

The spatial positions of the device 1, which is, for example controlling a betatron with radiator head and surgical bed, are designated by the position parameters e, $\alpha$, r, s, q, v.

The positions of the betatron radiator head are designated by the position parameters e, $\alpha$, r. In particular, the position parameter e determines the movement of the radiator head in the longitudinal direction of the surgical bed, the position parameter $\alpha$ the angle of rotation of the radiator head about the isocentric axis, and the position parameter r the movement in the direction of radiation of the radiator head.

The positions of the surgical bed are designated by the position parameters s, q, v. In particular, the position parameter s determines the position in the longitudinal direction, the position parameter q the position in the transverse direction, and the position parameter v the position in the vertical direction of the surgical bed.

The position parameters e, $\alpha$, r, s, q, v are set by means of the actuators *7a–7f* of the device 1.

The manual unit 2 is equipped with parameter selection keys 3a–3f, keys for additional functions 9a–9f, a slider 4 which is helf in the stable rest position 0 by means of a spring, an emergency switch 10 and signal lamps 11a–11l. The unit is operated by means of one hand 18, namely the index finger 13, the middle finger 14, the ring finger 15, the little finger 16 and the thumb 17 of the operator.

The process control unit can be, for example, a microcomputer of the type HLF from Messrs. Indel, Dübendorf (Switzerland). The input unit is, for example, a unit of the Maxiswitch Co, and the monitor is an RCA TC 1214 type monitor.

Pressing of, for example, the key 3a causes the parameter value e, that is to say the position of the radiator head in the longitudinal direction, to be indicated on the monitor 8. If in addition the slider 4 is moved, for example, in direction a, the radiator head is moved forward in the longitudinal direction of the surgical bed by means of the actuator 7a. The degree of deviation of the slider 4 from the rest position 0 determines the speed of parameter change. In this case two discrete steps are provided in the forward direction and two in the reverse direction.

However, it is also possible to have a continuous deviation of the slider 4 and thus a continuous control of the speed of parameter change.

In the same way the parameter is changed in the reverse direction if the slider 4 is pushed in direction b.

In the same sense, this applies to the other parameter positions such as radius r and angle of rotation $\alpha$ of the radiator head and longitudinal direction s, transverse direction q and vertical direction v of the surgical bed. The corresponding keys are 3b to 3f.

The process control unit 5 is programmed in such a way that, if two parameter selection keys 3a–3f are pressed simultaneously, only one signal will ever be considered. That is, only one single parameter change will be executed. In the same sense, this applies if several keys 3a–3f or additional function keys 9b, 9e and 9f are pressed simultaneously.

The keys 9e and 9f and the slider 4 can be used to increase or reduce the aperture of the iris of the radiator head in width (x direction) and length (y direction).

The key 9b, in conjunction with the slider 4, permits the radiator head to be rotated away from the isocentric axis.

Pressing of, for example, the parameter selection key 3a and the key 9c causes the parameter position, in this case the longitudinal direction e of the radiator head (nominal value), to be automatically set. The lamp 11g or 11h indicates the direction of parameter change. When the nominal value has been reached, the lamps 11a and 11k are turned on.

In the same sense, this applies to the other parameter selection keys 3b–3f and the corresponding lamps 11b–11f. In the same way, this applies to the additional function keys 9b, 9e and 9f, and the lamp 11j.

The whole device 1 is brought into its initial position by pressing the two keys 9c and 9d. This initial position has been reached when the lamps 11k and 11l are lit.

If the radiator head is touched, the lamp 11i lights up. The instantaneous parameter changes are then automatically interrupted by the blocking system of the process control unit 5. The blocking system can be disabled by means of the key 9a so that further parameter changes can be deliberately executed.

Figure 3:
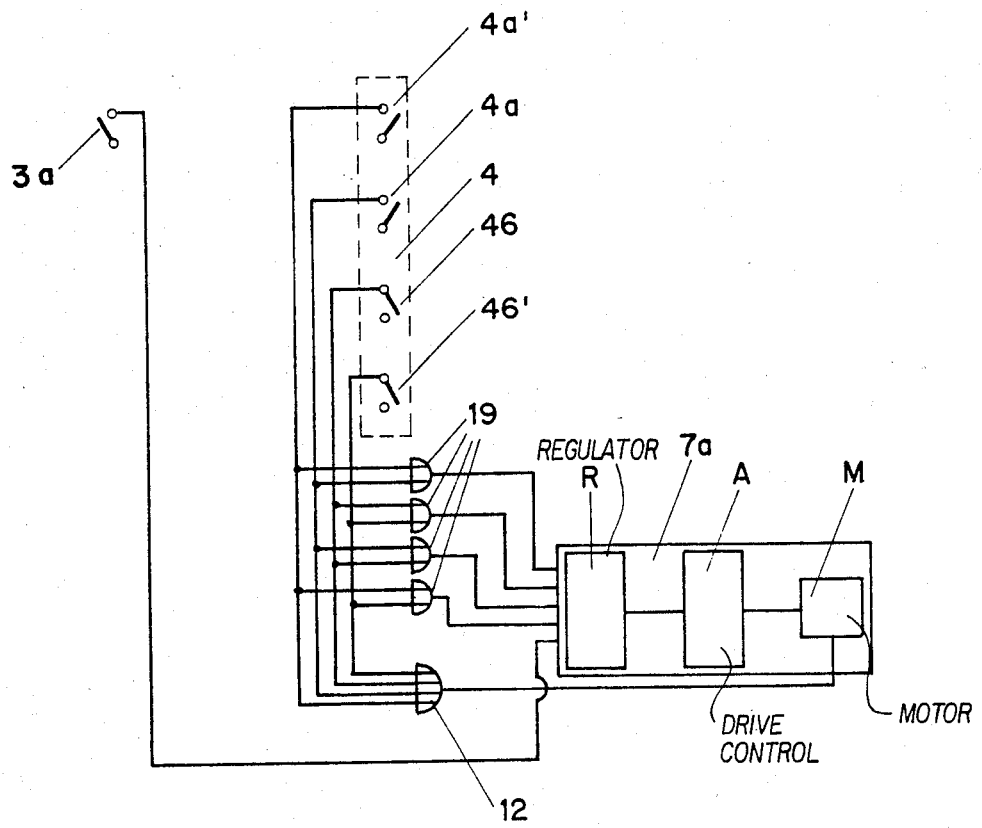
FIG. 3 shows a possible implementation of the process control unit.

FIG. 3 shows by way of example how the process control unit 5 works in conjunction with the actuators 7a–7f.

In FIG. 3, the process control unit 5 is implemented by a simple logic circuit which in this case consists of the OR gates 19. In the example shown, the actuators 7a–7f, represented here by actuator 7a, consist of a regulator R, a drive control unit A and a motor M. The OR gate 12 corresponds to the gate 12 shown in FIG. 1.

The operation of the elements shown is as follows.

When the key 3a is closed, a signal is supplied to the regulator R. If the slider 4 is then placed into a first position in which, for example, the switch 4a is closed, two OR gates 19 are enabled of which one provides the "forward" command and the other the "slow" command to the regulator R. Accordingly, the regulator R now enables the drive control unit A. The motor M, however, is started only if a signal arrives also from the OR gate 12. This is the case when the switch 4a is closed.

The OR gate 12 thus guarantees that the deadman's requirement is met.

If due to a fault in the regulator R and/or the drive control unit A the motor M is actuated without the slider 4 being operated, the motor M will still not start up since for this purpose another signal is required which is effected by the slider 4 via the OR gate 12. The power supply for the motor M is interrupted without such a signal.

Closing of the switch 4a results basically in the same operational sequence but the rectangular R causes the motor M to run at a higher speed.

If the switches 4b, 4b' *are closed the motor M reverses its direction of movement.*

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A system for controlling a plurality of position parameters of a spatially movable device comprising:

a plurality of actuators, each of said actuators corresponding to and acting upon one of said position parameters;

a hand-held manual unit provided with a plurality of control elements for selecting and controlling the change of said position parameters by means of the actuation of the corresponding ones of said plurality of actuators wherein said control elements include a plurality of trigger switches which are disposed on a first lateral face of said manual unit, whereby said trigger switches are positioned on said lateral face so that said trigger switches can be manipulated by the index, middle, ring and little finger of one hand of an operator while holding said manual unit and wherein said control elements further include a sliding means which is disposed on a second lateral face of said manual unit which second lateral face is opposite to said first lateral face and whereby said sliding means is disposed on said second lateral face in such a manner that said sliding means can be manipulated by the thumb of said one hand, and wherein said sliding means is disposed so as to be movable from a stable rest position in two opposite directions;

first means for activating a selected one of said actuators in correspondence to a selected one of said trigger switches with said means for activating being connected to said trigger switches and said actuators;

means for controlling the direction and speed of change of each of said actuators in correspondence to the direction and absolute value of deviation of said sliding means from said stable rest position, wherein said means for controlling is connected to said sliding means and said actuators; and means for preventing any of said actuators from being activated as long as said sliding means is in said stable rest position, wherein said means for preventing is connected to said sliding means and said actuators.

2. A system as claimed in claim 1, wherein said sliding means of said manual unit is continuously deviated.

3. A system as claimed in claim 1, wherein said sliding means of said manual unit is deviated in discrete steps.

4. A system as claimed in claim 1, wherein the values of said position parameters are displayed on a monitor.

5. A system as claimed in claim 1, further includes an emergency switch on said manual unit.

6. A system as claimed in claim 1, further including a second plurality of trigger switches on said manual unit for additional functions.

7. A system as claimed in claim 1, further including a plurality of signal lamps located on said manual unit.

8. A system as claimed in claim 1, wherein said spatially movable device comprises a betatron and a surgical bed.

9. A system as claimed in claim 1, further including a switch element provided between said sliding means and said actuators in order to permit one of said actuators to become activated only when said slider is deviated from said rest position.

* * * * *